United States Patent [19]

Ishiwata

[11] Patent Number: 4,473,302

[45] Date of Patent: Sep. 25, 1984

[54] ELECTRONIC DEVICE

[75] Inventor: Junichi Ishiwata, Yokohama, Japan

[73] Assignee: Canon Kabushiki Kaisha, Tokyo, Japan

[21] Appl. No.: 438,629

[22] Filed: Nov. 2, 1982

Related U.S. Application Data

[63] Continuation of Ser. No. 279,958, Jul. 2, 1981, abandoned, which is a continuation of Ser. No. 104,843, Dec. 18, 1979, abandoned.

[30] Foreign Application Priority Data

Dec. 24, 1978 [JP] Japan ..... 53-165876

[51] Int. Cl.[3] ..... G04C 23/00

[52] U.S. Cl. ..... 368/66

[58] Field of Search ..... 368/10, 66, 82, 223; 324/29.5; 340/248 R, 249

[56] References Cited

U.S. PATENT DOCUMENTS

| | | | |
|---|---|---|---|
| 3,813,533 | 5/1974 | Cone et al. | 368/223 |
| 4,041,691 | 8/1977 | Chihara et al. | 368/66 |
| 4,070,649 | 1/1978 | Wright, Jr. et al. | 368/10 |
| 4,163,193 | 7/1979 | Kamiya | 368/66 |

*Primary Examiner*—Vit W. Miska

*Attorney, Agent, or Firm*—Fitzpatrick, Cella, Harper & Scinto

[57] ABSTRACT

An electronic device comprises means for manually entering information relating to the battery and means for informing the exchange time of the battery in relation to said manual entry means.

3 Claims, 4 Drawing Figures

ELECTRONIC DEVICE

This is a continuation of application Ser. No. 279,958, filed July 2, 1981, now abandoned which was a continuation of prior application Ser. No. 104,843, filed Dec. 18, 1979, also now abandoned.

BACKGROUND OF THE INVENTION

1. Field of the Invention

The present invention relates to a device for use in a digital information processing electronic apparatus such as an electronic calculator combined with clock or a camera and for informing the user thereof of the replacing time of the battery.

2. Description of the Prior Art

The clock-combined electronic calculators which have recently become popular in the market employ CMOS large-scale integrated circuit elements for the processing unit and field-effect type liquid crystal elements for the display unit to achieve a low power consumption. Such apparatus working on very small batteries such as button-type silver oxide cell or coin-type lithium cell generally require battery replacement only once a year. Also there is becoming known an air-zinc battery which has a service life of two years or longer in a same size as that of the abovementioned batteries.

It is therefore required for a user to maintain a memorandum on the date of replacement, species and capacity of the replaced battery and estimated service life thereof and to thereafter replace the battery according to such data as otherwise the apparatus suddenly becomes unusable because of the battery run-out, thus causing significant inconvenience and uneasiness to the user.

SUMMARY OF THE INVENTION

In consideration of the above-mentioned drawbacks of the prior art, the object of the present invention is to provide an alarm device capable of automatically informing the user of the replacement time of the battery in response to the information relating thereto to be entered at the loading of said battery, thereby avoiding the uneasiness to the user.

The present invention will be clarified in detail by the following description on an embodiment thereof shown in the attached drawings.

DESCRIPTION OF THE PREFERRED EMBODIMENTS

Figure 1:
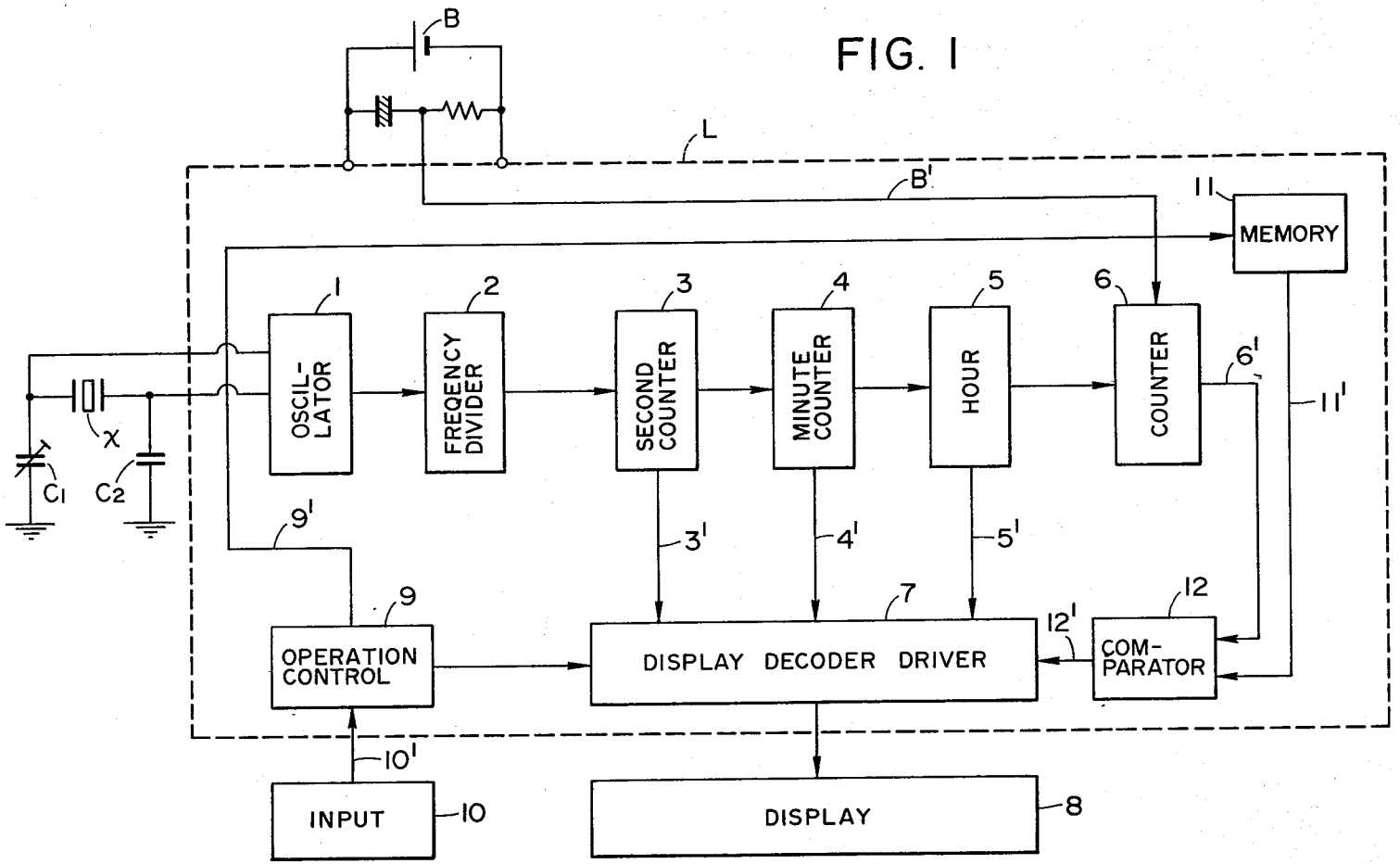
FIG. 1 is a block diagram of an embodiment of the present invention.

Referring to FIG. 1 showing an embodiment of the present invention in a block diagram, there are shown a logic circuit L composed for example of a CMOS large-scale intergrated circuit, and a battery B for supplying power thereto. The logic circuit L includes an oscillator 1 for generating clock pulses by means of an oscillating element X such as a crystal oscillating element and capacitors C1 and C2, a frequency divider 2 for counting down the frequency of said clock pulses to a pulse per second, a sexagesimal second counter 3 for counting the pulses supplied every second from said frequency divider 2, a sexagesimal minute counter 4 to be advanced every minute by the sexagesimal overflow output of said second counter 3, and a duodecimal hour counter 5 to be advanced every hour by the sexagesimal overflow output of said minute counter 4. The outputs 3', 4' and 5' of said second counter 3, minute counter 4 and hour counter 5 are supplied to a display decoder driver 7 for display on a display unit 8. A counter 6 for counting the battery using time is advanced by the duodecimal overflow output of said hour counter 5 whereby said counter 6 being advanced twice a day in the present embodiment.

Figure 3:
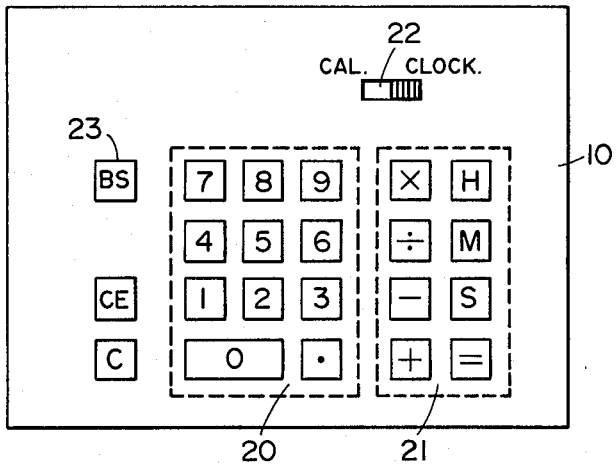
FIG. 3 is a view of an embodiment of the data entry unit of the present invention.

Further there is shown in the logic circuit an operation control unit 9 for the calculator and clock and for conducting processing operations in response to the input signals 10' from an input unit 10 such as a keyboard. A battery capacity memory 11 is connected to the control unit 9, and a comparator 12 compares the contents of the counter 6 and said memory 11 and releases an output signal upon coincidence of said contents. Also FIG. 3 shows an example of the keyboard 10, which comprises a numerical key group 20 for entering numerical information and an instruction key group 21 for entering operational instructions, both for processing in the operation control unit.

Further there are shown a switch 22 for selecting the clock mode and the calculator mode a key 23 for entering the information relating to the battery loaded, for example the nominal battery capacity in ampere-hours, or the service life of the battery in years, months or days. In the following description it is assumed that the service life in years is taken as said information. In case a new battery of a one-year service life is loaded into the apparatus, the counter 6 is reset by the signal line B'. Upon subsequent entry of the numeral "1" by the numerical key group 20 followed by the actuation of the battery information key 23, the operation control unit 9 performs a calculation 1 year$\times$365 days$\times$2=730 according to a preprogrammed instructions, of which output signal 9' is stored in the battery capacity memory 12. On the other hand the battery using time counter 6 continues to be advanced twice a day.

Figure 2A:
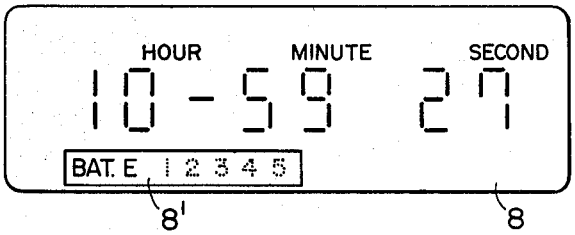
FIGS. 2A and 2B are views of embodiments of the display to be employed in the present invention.
Figure 2B:
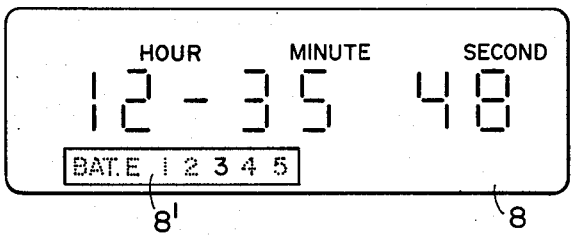

Consequently the output signal 12' is released when the content of said counter 6 becomes equal to that of said battery information memory 12 one year after the loading of said battery B, whereby said display decoder driver 7 activates a battery replacement alarm display 8' in the display unit 8 to inform the user of the need for the battery replacement, as shown in FIG. 2A. Also it is possible to store plural data such as "728, 726, 724, . . . " in said battery information memory 12 or to modify the program for the operation control unit 9 to control the comparator 12 in such a manner as to display the number of remaining days before the battery replacement as shown in FIG. 2B, the illustration showing three days remaining before the replacement.

As explained in the foregoing, the present invention allows to inform the user of the battery replacement time by means of a simple additional circuit.

What I claim is:

1. An electronic device powered by a battery, comprising:

a set of numeral keys for entering numerical information relating to the expected useful lifetime of the battery;

memory means connected to said set of numeral keys for storing therein the numerical information;

calculation means for calculating the time from insertion of the battery into said device to the end of the expected useful lifetime of the battery;

comparison means for comparing the numerical information stored in said memory means with the time calculated by said calculation means; and digital display means responsive to said comparison means for visually displaying numerical information indicative of the remaining useful lifetime of the battery.

2. A device according to claim 1, wherein said electronic device includes a desk-top electronic calculator and wherein said digital display means includes a digital display device for use in the desk-top electronic calculator.

3. A device according to claim 1, wherein said electronic device includes a digital timepiece and wherein said digital display means includes a digital display device for use in the timepiece.

* * * * *